US010148011B2

(12) United States Patent
Wu et al.

(10) Patent No.: US 10,148,011 B2
(45) Date of Patent: Dec. 4, 2018

(54) ANTENNA STRUCTURE

(71) Applicant: Arcadyan Technology Corporation, Hsinchu (TW)

(72) Inventors: Min-Chi Wu, Zhubei (TW); I-Min Chen, Kaohsiung (TW)

(73) Assignee: Arcadyan Technology Corporation (TW)

( * ) Notice: Subject to any disclaimer, the term of this patent is extended or adjusted under 35 U.S.C. 154(b) by 0 days.

(21) Appl. No.: 15/673,113

(22) Filed: Aug. 9, 2017

(65) Prior Publication Data

US 2018/0269578 A1 Sep. 20, 2018

(30) Foreign Application Priority Data

Mar. 15, 2017 (TW) ..... 106108590 A

(51) Int. Cl.

| | |
|---|---|
| ***H01Q 1/24*** | (2006.01) |
| ***H01Q 1/52*** | (2006.01) |
| ***H01Q 5/35*** | (2015.01) |
| ***H01Q 5/40*** | (2015.01) |
| ***H01Q 9/42*** | (2006.01) |
| ***H01Q 21/28*** | (2006.01) |

(Continued)

(52) U.S. Cl.

CPC ..... *H01Q 5/40* (2015.01); *H01Q 1/243* (2013.01); *H01Q 1/521* (2013.01); *H01Q 5/321* (2015.01); *H01Q 5/328* (2015.01); *H01Q 5/35* (2015.01); *H01Q 9/42* (2013.01); *H01Q 21/28* (2013.01)

(58) Field of Classification Search

None

See application file for complete search history.

(56) References Cited

U.S. PATENT DOCUMENTS

| | | | |
|---|---|---|---|
| 8,085,202 | B2 | 12/2011 | Ayatollahi et al. |
| 8,937,578 | B2 | 1/2015 | Montgomery |

(Continued)

FOREIGN PATENT DOCUMENTS

| | | | |
|---|---|---|---|
| CN | 102570010 | | 9/2014 |
| EP | 2680365 | A1 | 1/2014 |
| EP | 3065215 | A1 | 9/2016 |

OTHER PUBLICATIONS

European Search Report corresponding to EP17192182, dated Mar. 27, 2018, 1 page.

*Primary Examiner* — Howard Williams

(74) *Attorney, Agent, or Firm* — Innovation Counsel LLP

(57) ABSTRACT

An antenna structure including a substrate, a grounding layer, a first antenna layer, a second antenna layer, an inductance element and a capacitance element is provided. The substrate has a surface. The grounding layer is formed on the surface of the substrate. The first antenna layer includes a first radiating portion and a second radiating portion. The second antenna layer includes a third radiating portion and a fourth radiating portion. The third radiating portion is connected to the first radiating portion at a connection portion. The connection portion is separated from the grounding player, and the fourth radiating portion and the second radiating portion are disposed oppositely and separated from each other. The inductance element bridges the grounding layer and the connection portion. The capacitance element bridges the fourth radiating portion and the second radiating portion.

20 Claims, 12 Drawing Sheets

(51) Int. Cl.
*H01Q 5/321* (2015.01)
*H01Q 5/328* (2015.01)

(56) References Cited

U.S. PATENT DOCUMENTS

| | | | | |
|---|---|---|---|---|
| 2008/0158068 | A1* | 7/2008 | Huang | H01Q 1/243 343/700 MS |
| 2010/0013732 | A1* | 1/2010 | Kapuliansky | H01Q 1/243 343/866 |
| 2011/0050528 | A1 | 3/2011 | Montgomery | |
| 2014/0104115 | A1* | 4/2014 | Huang | H01Q 9/42 343/700 MS |
| 2016/0294062 | A1* | 10/2016 | Lo Hine Tong | H01Q 1/2291 |
| 2017/0194692 | A1* | 7/2017 | Sayama | H01Q 5/385 |

* cited by examiner

ANTENNA STRUCTURE

This application claims the benefit of Taiwan application Serial No. 106108590, filed Mar. 15, 2017, the disclosure of which is incorporated by reference herein in its entirety.

TECHNICAL FIELD

The disclosure relates in general to an antenna structure, and more particularly to an antenna structure including passive elements.

BACKGROUND

As the communication devices are getting smaller and smaller to comply with the design trend of lightweight, thinness and compactness, the antenna structures disposed on the communication devices also need to be miniaturized. However, when most antenna structures are multi-input multi-output (MIMO) antennas, and several antennas are disposed within a limited planar area, it is inevitable that signal interference will occur between antennas. Therefore, how to reduce signals interference between antennas or increase the isolation between antennal signals has become a prominent task for the industries.

SUMMARY

The disclosure is directed to an antenna structure capable of resolving the generally known problems.

According to one embodiment, an antenna structure is provided. The antenna structure includes a substrate, a grounding layer, a first antenna layer, a second antenna layer, an inductance element and a capacitance element. The substrate has a surface. The grounding layer, the first antenna layer and the second antenna layer are formed on the surface of the substrate. The first antenna layer includes a first radiating portion and a second radiating portion which are interconnected with each other. The second antenna layer includes a third radiating portion and a fourth radiating portion which are interconnected with each other. The third radiating portion is connected to the first radiating portion at a connection portion. The connection portion is separated from the grounding player. The fourth radiating portion and the second radiating portion are disposed oppositely and separated from each other by a spacing. The inductance element bridges the grounding layer and the connection portion. The capacitance element bridges the spacing between the fourth radiating portion and the second radiating portion.

According to another embodiment, an antenna structure is provided. The antenna structure includes a substrate, a grounding layer, a first antenna layer, a second antenna layer, a capacitance element, a first recess and a second recess. The substrate has a surface. The grounding layer, the first antenna layer and the second antenna layer are formed on the surface of the substrate. The first antenna layer includes a first radiating portion and a second radiating portion which are interconnected with each other. The second antenna layer includes a third radiating portion and a fourth radiating portion which are interconnected with each other. The third radiating portion is connected to the first radiating portion at a connection portion. The connection portion is separated from the grounding player. The fourth radiating portion and the second radiating portion are disposed oppositely and separated from each other by a spacing. The capacitance element bridges the spacing between the fourth radiating portion and the second radiating portion. The first recess is disposed on a slot surrounded by a connection portion of the first radiating portion and the second radiating portion, the first radiating portion and the second radiating portion. The second recess is disposed on another slot surrounded by a connection portion of the third radiating portion and the fourth radiating portion, the third radiating portion and the fourth radiating portion. The capacitance element bridges the fourth radiating portion and the second radiating portion.

The above and other aspects of the invention will become better understood with regard to the following detailed description of the preferred but non-limiting embodiment(s). The following description is made with reference to the accompanying drawings.

Figure 1:
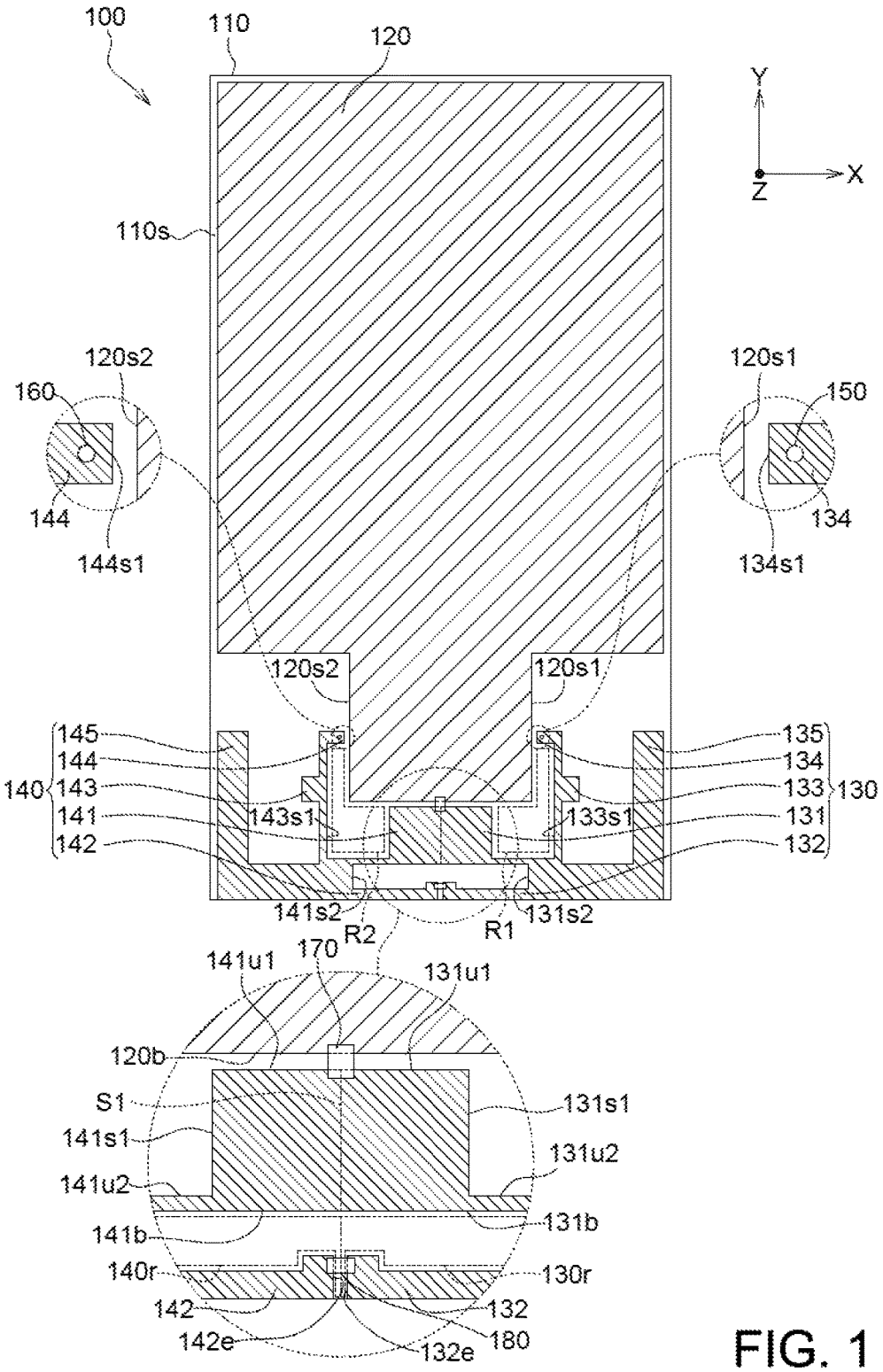
FIG. 1 is a top view of an antenna structure according to an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

FIG. 1 is a top view of an antenna structure 100 according to an embodiment of the invention. The antenna structure 100 includes a substrate 110, a grounding layer 120, a first antenna layer 130, a first recess 130*r*, a second antenna layer 140, a second recess 140*r*, a first feed point 150, a second feed point 160, an inductance element 170 and a capacitance element 180.

The substrate 110 has a surface 110*s*. The grounding layer 120, the first antenna layer 130, the second antenna layer 140, the first feed point 150, the second feed point 160, the inductance element 170 and the capacitance element 180 all are located on the same surface 110*s* of the substrate 110.

The first antenna layer 130 and the second antenna layer 140 can have a similar or symmetric structure, and together provide a working band to the antenna structure 100. In another embodiment, if the first antenna layer 130 and the second antenna layer 140 have different structures, the first antenna layer 130 and the second antenna layer 140 will provide different working bands. In another embodiment, the antenna structure 100 further includes at least a third antenna layer (not illustrated) laterally connected to the first antenna layer 130 and/or the second antenna layer 140 for additionally providing at least a working band to the antenna structure 100.

The first antenna layer 130 includes a first radiating portion 131 and a second radiating portion 132, which are electrically connected to each other and disposed oppositely along a Y axial direction. The second antenna layer 140 includes a third radiating portion 141 and a fourth radiating portion 142, which are electrically connected to each other and disposed oppositely along the Y axial direction. The third radiating portion 141 is connected to the first radiating portion 131 at a connection portion S1. The connection portion S1 is separated from the grounding player 120. The connection portion S1 is connected to the grounding layer 120 at an inductance element 170. The fourth radiating portion 142 and the second radiating portion 132 are disposed oppositely and separated from each other. The fourth radiating portion 142 and the second radiating portion 132 are connected via capacitance element 180.

Through the design of the inductance L of the inductance element 170 and the capacitance C of the capacitance element 180, the inductance element 170 and the capacitance element 180 can resonate at a specific frequency to isolate the radio frequency signal of the first antenna layer 130 and the second antenna layer 140 and reduce signal interference between the first antenna layer 130 and the second antenna layer 140. Thus, even when the first antenna layer 130 and the second antenna layer 140 are very small in size or are very close to each other (for example, the first antenna layer 130 and the second antenna layer 140 are disposed within a limited space or planar area), the inductance element 170 and the capacitance element 180 can couple a resonance frequency and therefore reduce signal interference between the first antenna layer 130 and the second antenna layer 140. Furthermore, the lower the signal interference between the first antenna layer 130 and the second antenna layer 140, the better the isolation between the first antenna layer 130 and the second antenna layer 140. The product of the inductance L and the capacitance C is K (K=L*C), and the isolation between the first antenna layer 130 and the second antenna layer 140 has much to do with the product K. In an embodiment, the capacitance C of the capacitance element 180 is between 0.6 picofarad (pF) and 150 pF, and the inductance L of the inductance element 170 is between 6 nahan (nH) and 22 nH. Thus, excellent isolation between the first antenna layer 130 and the second antenna layer 140 can be achieved, and signal interference can be reduced. In another embodiment, the antenna structure 100 still can achieve similar technical effect even when the inductance element 170 is dispensed with.

As indicated in FIG. 1, the grounding layer 120 has the first grounding side 120*s*1, the second grounding side 120*s*2 and the grounding lower edge 120*b*, wherein the grounding lower edge 120*b* extends along the +/−X axial direction, and the first grounding side 120*s*1 and the second grounding side 120*s*2 extend along the +/−Y axial direction. The first radiating portion 131 has a first side 131*s*1, a first upper edge 131*u*1 and a second upper edge 131*u*2. The first side 131*s*1 extends along the +/−Y axial direction, and the first upper edge 131*u*1 and the second upper edge 131*u*2 extend along the +/−X axial direction. Besides, the first side 131*s*1 connects the first upper edge 131*u*1 and the second upper edge 131*u*2. A difference of height is formed between the first upper edge 131*u*1 and the second upper edge 131*u*2 along the length direction of the first side 131*s*1, wherein the first upper edge 131*u*1 is closer to the grounding lower edge 120*b* of the grounding layer 120 than the second upper edge 131*u*2 such that the inductance element 170 can bridge the first upper edge 131*u*1 and the grounding lower edge 120*b* at a shorter distance. In the diagram, the X axial direction as illustrated in the diagram can be one of the short side direction and the long side direction of the substrate 110, the Y axial direction can be the other of the short side direction and the long side direction of the substrate 110, and the Z axial direction is the vertical direction of the surface 110*s* of the substrate 110, that is, the direction perpendicular to the paper. However, the X axis can form an acute angle with one of the short side and the long side of the substrate 110, and the Y axis can form an acute angle with the other of the short side and the long side of the substrate 110.

Moreover, the first antenna layer 130 further includes a fifth radiating portion 133 extending to be opposite to the first grounding side 120*s*1 of the grounding layer 120 from the second upper edge 131*u*2 along the +Y axial direction. The fifth radiating portion 133 has a second side 133*s*1 opposite to the first grounding side 120*s*1, wherein a first resonance cavity R1 is surrounded by the second side 133*s*1, the first grounding side 120*s*1, the grounding lower edge 120*b*, the second upper edge 131*u*2 and the first side 131*s*1. The first resonance cavity R1 can resonate at a band different from that of the first antenna layer 130, such that the antenna structure 100 becomes a multi-band antenna.

As indicated in FIG. 1, the third radiating portion 141 has the third side 141*s*1, the third upper edge 141*u*1 and the fourth upper edge 141*u*2. The third side 141*s*1 extends along the +/−Y axial direction, and the third upper edge 141*u*1 and the fourth upper edge 141*u*2 extend along the +/−X axial direction. Besides, the third side 141*s*1 connects the third upper edge 141*u*1 and the fourth upper edge 141*u*2. A difference of height is formed between the third upper edge 141*u*1 and the fourth upper edge 141*u*2 along the length direction of the third side 141*s*1, wherein the third upper edge 141*u*1 is closer to the grounding lower edge 120*b* of the grounding layer 120 than the fourth upper edge 141*u*2, such that the inductance element 170 can bridge the third upper edge 141*u*1 and the grounding lower edge 120*b* at a shorter distance. Besides, the second antenna layer 140 further includes a sixth radiating portion 143 extending to be opposite to the second grounding side 120*s*2 of the grounding layer 120 from the fourth upper edge 141*u*2 along the +Y axial direction. The sixth radiating portion 143 has a fourth side 143*s*1 opposite to the second grounding side 120*s*2, wherein a second resonance cavity R2 is surrounded by the fourth side 143*s*1, the second grounding side 120*s*2, the grounding lower edge 120*b*, the fourth upper edge 141*u*2 and the third side 141*s*1. The second resonance cavity R2 can resonate at a band different from that of the second antenna layer 140, such that the antenna structure 100 becomes a multi-band antenna.

As indicated in FIG. 1, the second radiating portion 132 extends along the +/−X axial direction and has a fifth side 132*e*, and the fourth radiating portion 142 extends along the +/−X axial direction and has a sixth side 142*e*, wherein the fifth side 132*e* and the sixth side 142*e* are disposed oppositely and isolated from each other. The capacitance element 180 crosses over the fifth side 132*e* and the sixth side 142*e* to bridge the second radiating portion 132 and the fourth radiating portion 142 for electrically connecting the second radiating portion 132 and the fourth radiating portion 142.

As indicated in FIG. 1, the first recess 130*r* is disposed in a slot formed by the connection between the first radiating portion 131 and the second radiating portion 132, the first radiating portion 131 and the second radiating portion 132. The first recess 130*r* extends to the seventh side 131*s*2 of the first radiating portion 131 from the fifth side 132*e* of the second radiating portion 132 along the +X axial direction and extends to the first lower edge 131*b* of the first radiating portion 131 along the +Y axial direction. The second recess 140*r* is disposed in another slot formed by the connection between the third radiating portion 141 and the fourth radiating portion 142, the third radiating portion 141 and the fourth radiating portion 142, wherein the second recess 140*r* and the first recess 130*r* are interconnected with each other. In an embodiment, the fourth radiating portion 142 and the second radiating portion 132 are disposed oppositely and separated from each other by a spacing, and the second recess 140*r* and the first recess 130*r* are interconnected with each other, wherein, the spacing is not any part of the second recess 140*r* and/or any part of the first recess 130*r*; or, the spacing can be a part of the second recess 140*r* and/or a part of the first recess 130*r*. Specifically, the second recess 140*r* extends to the eighth side 141*s*2 of the third radiating portion 141 from the sixth side 142*e* of the fourth radiating portion 142 along the −X axial direction and extends to the second lower edge 141*b* of the third radiating portion 141 along the +Y axial direction. The sizes and extension types of first recess 130*r* and the second recess 140*r* can be used to assist with the matching design of the first antenna layer 130 and/or the second antenna layer 140. In an embodiment, the first recess 130*r* and the second recess 140*r* are symmetric with each other.

As indicated in FIG. 1, the first antenna layer 130 further includes a seventh radiating portion 134 extending towards the first grounding side 120*s*1 of the grounding layer 120 from the fifth radiating portion 133 of the second side 133*s*1. The seventh radiating portion 134 has a ninth side 134*s*1 opposite to the first grounding side 120*s*1. The first feed point 150 is located on the seventh radiating portion 134. Although it is not illustrated in the diagram, the antenna structure 100 may further include a first feed wire (not illustrated) having a live wire and a ground wire which are isolated from each other, wherein the live wire can be connected to the first feed point 150, and the ground wire can be connected to the grounding layer 120.

As indicated in FIG. 1, the second antenna layer 140 further includes an eighth radiating portion 144 extending towards the second grounding side 120*s*2 of the grounding layer 120 from the fourth side 143*s*1 of the sixth radiating portion 143. The eighth radiating portion 144 has a tenth side 144*s*1 opposite to the second grounding side 120*s*2. The second feed point 160 is located on the eighth radiating portion 144. Although it is not illustrated in the diagram, the antenna structure 100 may further include a second feed wire (not illustrated) having a live wire and a ground wire which are isolated from each other, wherein the live wire can be connected to the second feed point 160, and the ground wire can be connected to the grounding layer 120.

As indicated in FIG. 1, the first antenna layer 130 further includes a ninth radiating portion 135 extending from the second upper edge 131*u*2 of the first radiating portion 131 along the +Y axial direction and opposite to the fifth radiating portion 133. The ninth radiating portion 135, the first radiating portion 131, the second radiating portion 132 and the fifth radiating portion 133 constitute a planar inverted-F antenna (PIFA). Similarly, as indicated in FIG. 1, the second antenna layer 140 further includes a tenth radiating portion 145 extending from the fourth upper edge 141*u*2 of the third radiating portion 141 along the +Y axial direction and opposite to the sixth radiating portion 143. The tenth radiating portion 145, the third radiating portion 141, the fourth radiating portion 142 and the sixth radiating portion 143 constitute a planar inverted-F antenna.

Figure 2:
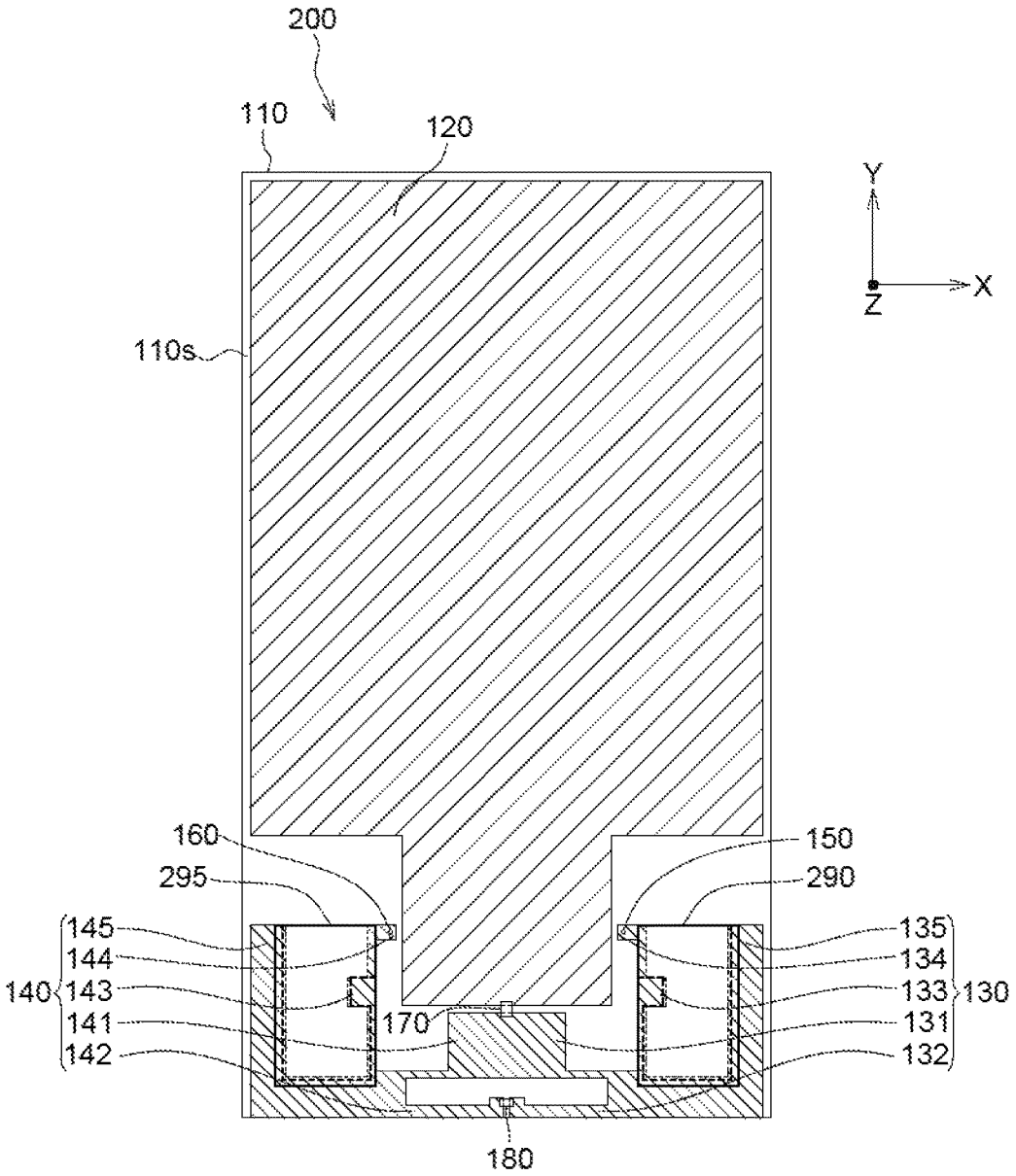
FIG. 2 is a top view of an antenna structure according to an embodiment of the invention.

FIG. 2 is a top view of an antenna structure 200 according to an embodiment of the invention. The antenna structure 200 includes a substrate 110, a grounding layer 120, a first antenna layer 130, a second antenna layer 140, a first feed point 150, a second feed point 160, an inductance element 170, a capacitance element 180, a first electronic element 290 and a second electronic element 295.

The antenna structure 200 of the present embodiment of the invention is similar to the antenna structure 100 except that the first electronic element 290 of the antenna structure 200 is electrically connected to the fifth radiating portion 133, and is disposed on the first radiating portion 131, the fifth radiating portion 133 and the ninth radiating portion 135 of the first antenna layer 130 in a non-coplanar manner. In other words, the first electronic element 290 is stacked on the first antenna layer 130 along the Z axial direction. The first electronic element 290 can be realized by an antenna element. When the first electronic element 290 is realized by an antenna element, the first electronic element 290 can provide a working band different from that provided by the first antenna layer 130 and/or the first resonance cavity R1. Similarly, the second electronic element 295 of the antenna structure 200 is electrically connected to the sixth radiating portion 143, and is disposed on the third radiating portion 141, the sixth radiating portion 143 and the tenth radiating portion 145 of the second antenna layer 140 in a non-coplanar manner. In other words, the second electronic element 295 is stacked on the second antenna layer 140 along the Z axial direction. The second electronic element 295 can be realized by an antenna element. When the second electronic element 295 is realized by an antenna element, the second electronic element 295 can provide a working band different from that provided by the second antenna layer 140 and/or the second resonance cavity R2. In an embodiment, the first electronic element 290 and the second electronic element 295 can be separately disposed on an independent substrate. In other embodiment, the first electronic element 290 and the second electronic element 295 can be formed of metal or other conductive material.

Figure 3:
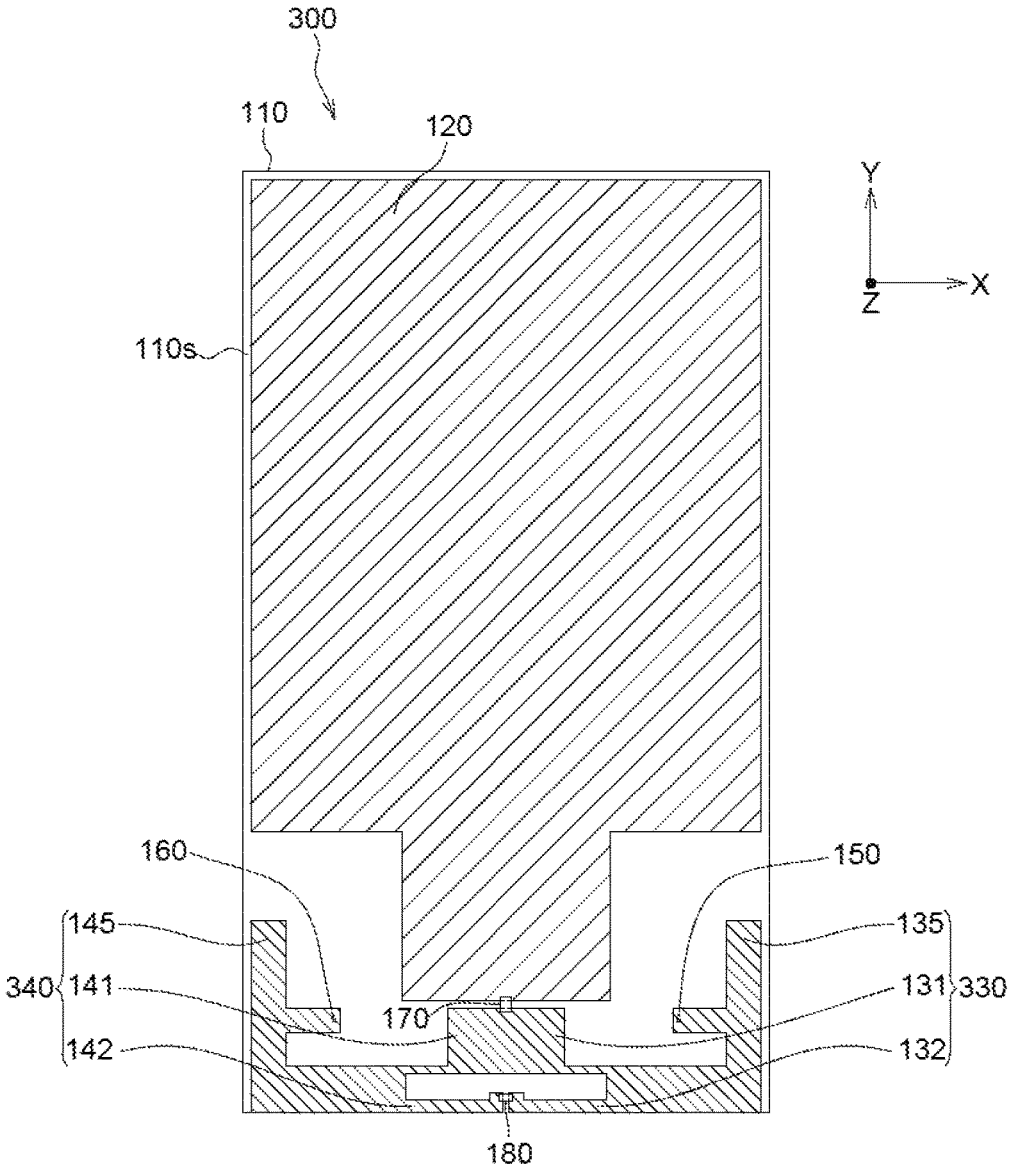
FIG. 3 is a top view of an antenna structure according to an embodiment of the invention.

FIG. 3 is a top view of an antenna structure 300 according to an embodiment of the invention. The antenna structure 300 includes a substrate 110, a grounding layer 120, a first antenna layer 330, a second antenna layer 340, a first feed point 150, a second feed point 160, an inductance element 170 and a capacitance element 180.

The antenna structure 300 of the present embodiment of the invention is similar to the antenna structure 100 except that the first antenna layer 330 dispenses with the fifth radiating portion 133 and the seventh radiating portion 134, and the second antenna layer 340 dispenses with the sixth radiating portion 143 and the eighth radiating portion 144. Under such design, the antenna structure 300 does not have the first resonance cavity R1 and the second resonance cavity R2.

Figure 4:
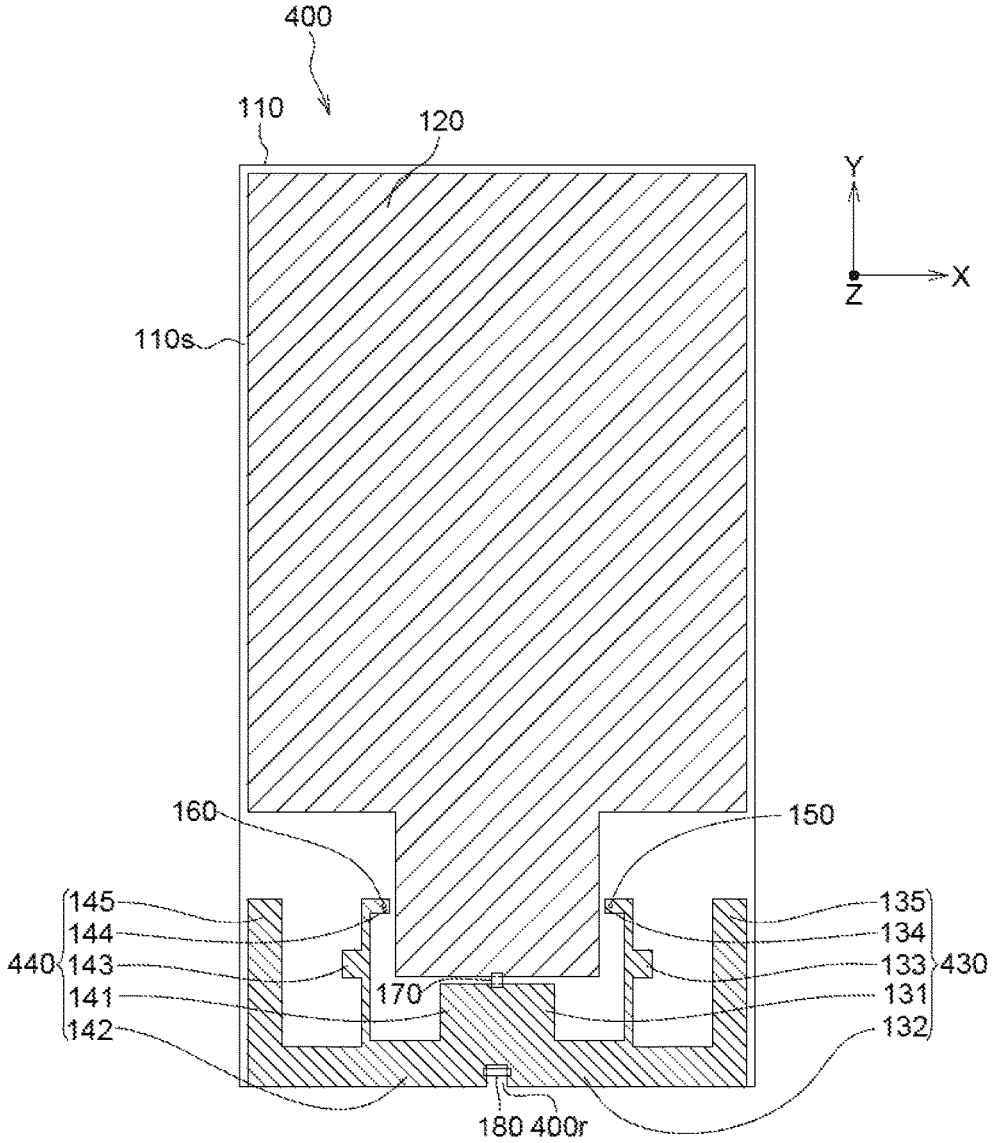
FIG. 4 is a top view of an antenna structure according to an embodiment of the invention.

FIG. 4 is a top view of an antenna structure 400 according to an embodiment of the invention. The antenna structure 400 includes a substrate 110, the grounding layer 120, the first antenna layer 430, the second antenna layer 440, the first feed point 150, the second feed point 160, the inductance element 170 and the capacitance element 180.

The antenna structure 400 of the present embodiment of the invention is similar to the antenna structure 100 except that the antenna structure 400 can dispense with most or the entirety of the first recess 130*r* and most or the entirety of the second recess 140*r* but reserves a spacing 400*r* whose area is substantially equivalent to or slightly larger than that of the capacitance element 18. As indicated in FIG. 4, the first lower edge 131*b* of the first radiating portion 131 of the first antenna layer 430 (illustrated in FIG. 1) is like directly connecting the second radiating portion 132, and the second lower edge 141*b* of the third radiating portion 141 of the second antenna layer 440 (illustrated in FIG. 1) is like directly connecting the fourth radiating portion 142.

Figure 5:
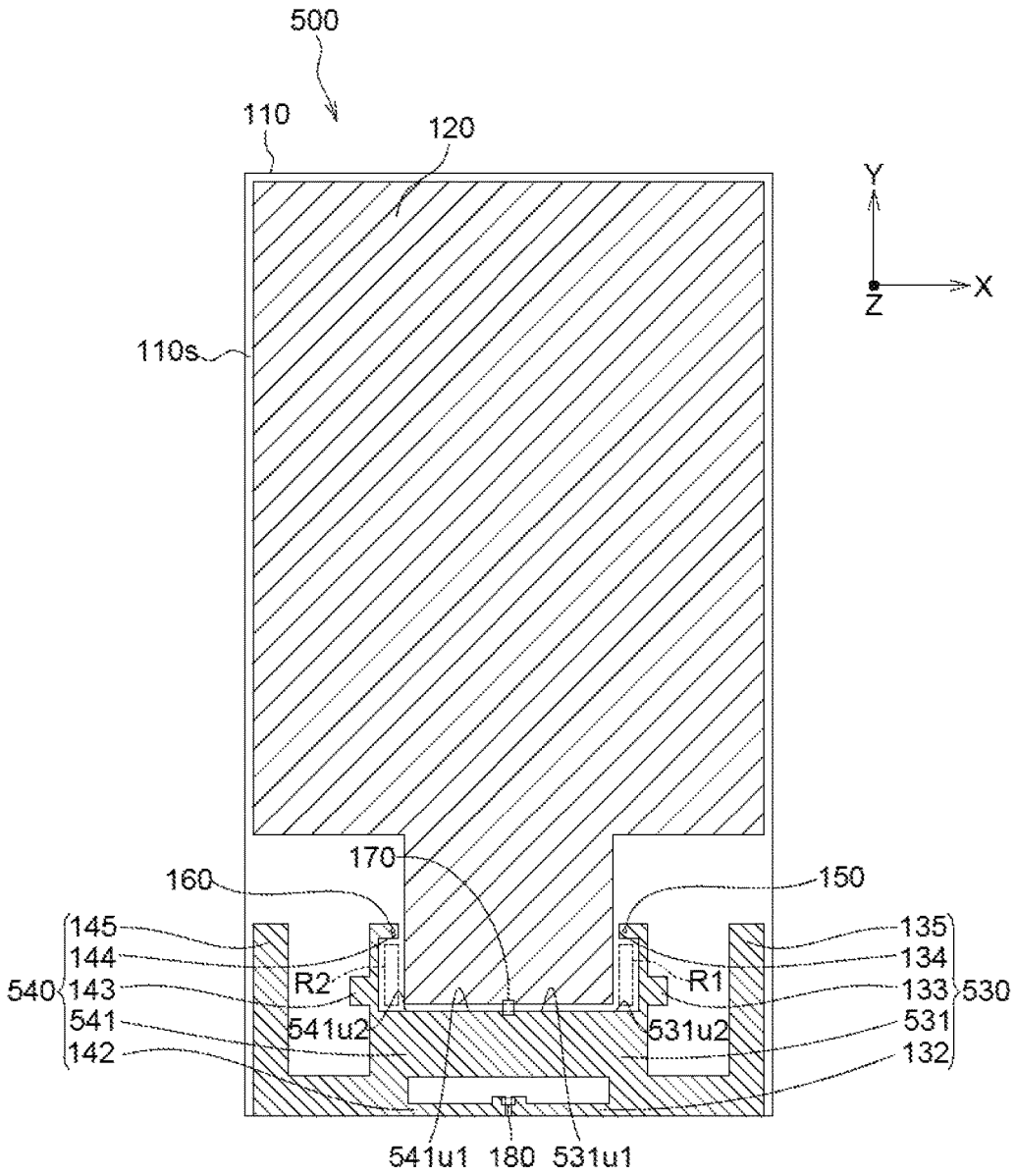
FIG. 5 is a top view of an antenna structure according to an embodiment of the invention.

FIG. 5 is a top view of an antenna structure 500 according to an embodiment of the invention. The antenna structure 500 includes a substrate 110, a grounding layer 120, a first antenna layer 530, a second antenna layer 540, a first feed point 150, a second feed point 160, an inductance element 170 and a capacitance element 180.

The antenna structure 500 of the present embodiment of the invention is similar to the antenna structure 100 except that the first upper edge 531*u*1 of the first radiating portion 531 of the first antenna layer 530 is aligned, such as collinear, with the second upper edge 531*u*2, and the third upper edge 541*u*1 of the third radiating portion 541 of the second antenna layer 540 is aligned, such as collinear, with the fourth upper edge 541*u*2. In another embodiment, the first upper edge 531*u*1 is aligned with the second upper edge 531*u*2, but a difference of height is formed between the third upper edge 541*u*1 and the fourth upper edge 541*u*2. Or, the third upper edge 541*u*1 is aligned with the fourth upper edge 541*u*2, but a difference of height is formed between the first upper edge 531*u*1 and the second upper edge 531*u*2.

As indicated in FIG. 5, the second upper edge 531*u*2 is upwardly aligned with the first upper edge 531*u*1, such that the space volume or area of the first resonance cavity R1 reduces and accordingly the first resonance cavity R1 can resonate at a working band with higher frequency. Similarly, the fourth upper edge 541*u*2 is upwardly aligned with the third upper edge 541*u*1, such that the space volume or area of the second resonance cavity R2 reduces and accordingly the second resonance cavity R2 can resonate at a working band with higher frequency. When the first resonance cavity R1 and the second resonance cavity R2 have different space volumes or areas, the first resonance cavity R1 and the second resonance cavity R2 can resonate at two different working bands respectively.

Figure 6:
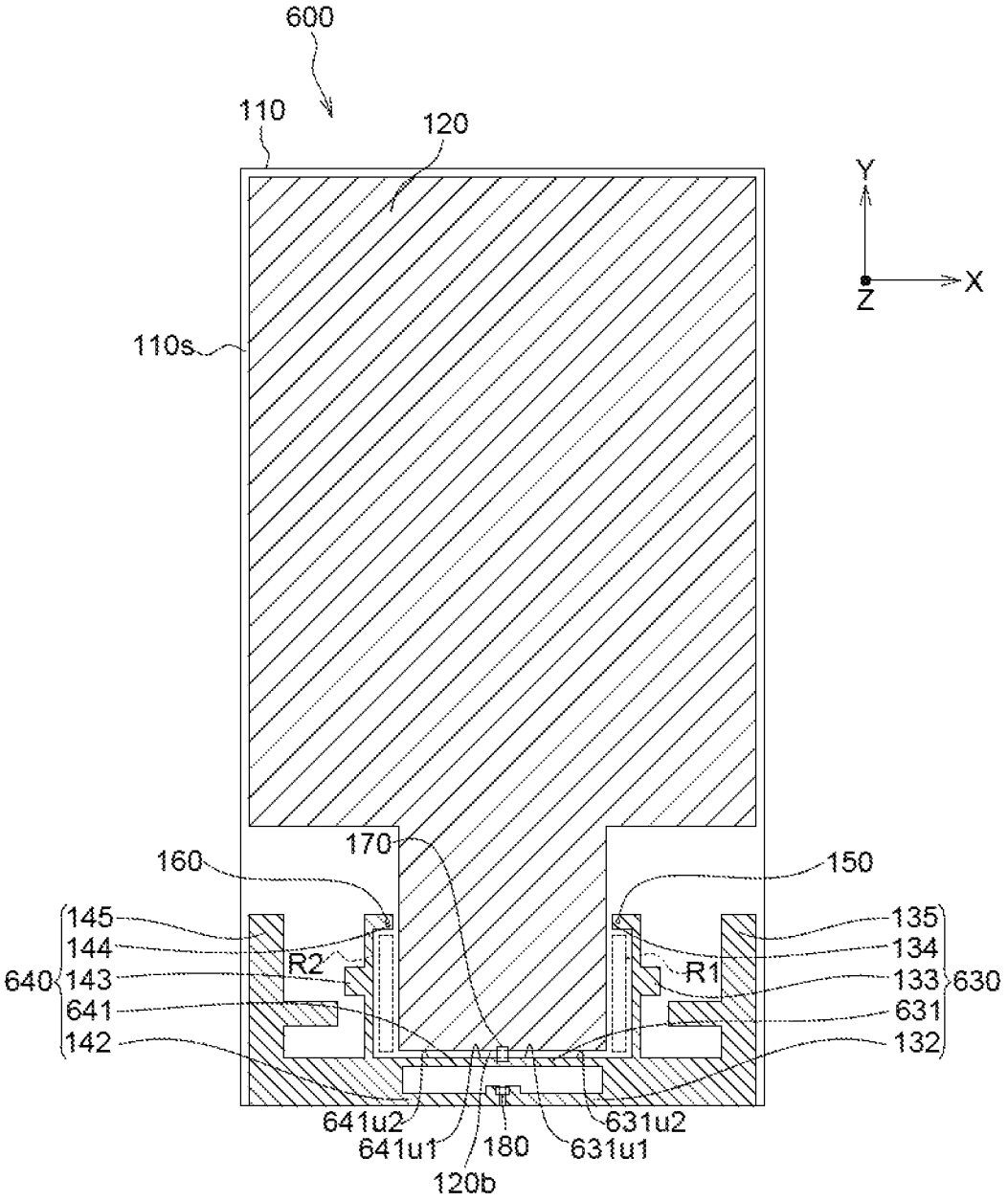
FIG. 6 is a top view of an antenna structure according to an embodiment of the invention.

FIG. 6 is a top view of an antenna structure 600 according to an embodiment of the invention. The antenna structure 600 includes a substrate 110, a grounding layer 120, a first antenna layer 630, a second antenna layer 640, a first feed point 150, a second feed point 160, an inductance element 170 and a capacitance element 180.

The antenna structure 600 of the present embodiment of the invention is similar to the antenna structure 100 except that the first upper edge 631*u*1 of the first radiating portion 631 of the first antenna layer 630 is downwardly aligned with the second upper edge 631*u*2 of the first radiating portion 631, and the grounding lower edge 120*b* of the grounding layer 120 accordingly descends towards the first upper edge 631*u*1 and the second upper edge 631*u*2, such that the space volume or area of the first resonance cavity R1 reduces and accordingly the first resonance cavity R1 can resonate at a working band with higher frequency. Similarly, the third upper edge 541*u*1 of the third radiating portion 641 of the second antenna layer 640 is downwardly aligned with the fourth upper edge 541*u*2 of the third radiating portion 641, and the grounding lower edge 120*b* of the grounding layer 120 accordingly descends towards the third upper edge 541*u*1 and the fourth upper edge 541*u*2, such that the space volume or area of the second resonance cavity R2 reduces and accordingly the second resonance cavity R2 can resonate at a working band with lower frequency.

In an embodiment as indicated in FIG. 1, through the adjustment of the position of the first side 131*s*1 of the first radiating portion 131 along the +/−X axial direction and/or the position of the third side 141*s*1 of the third radiating portion 141 along the +/−X axial direction, the space volume, area, or shape of the first resonance cavity R1 and/or the second resonance cavity R2 will be changed (such as expanded or reduced), and so will the working band generated by the resonance cavity be changed (such as increased or decreased). In another embodiment, through the design of the position of the fifth radiating portion 133 along the +/−X axial direction and/or the position of the sixth radiating portion 143 along the +/−X axial direction, similar effect still can be achieved.

Figure 7:
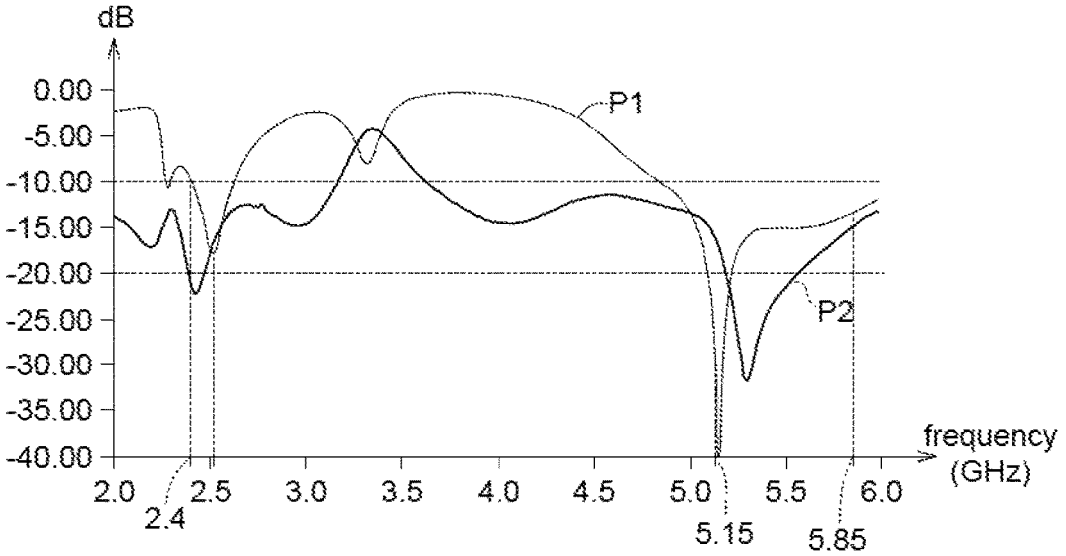
FIG. 7 is a characteristics curve diagram of the antenna structure of FIG. 1.

FIG. 7 is a characteristics curve diagram of the antenna structure 100 of FIG. 1. Curve P1 denotes the return loss of the antenna structure 100, and curve P2 denotes the isolation of the antenna structure 100.

It can be known from FIG. 7: the first antenna layer 130 and the second antenna layer 140 can resonate at a working band of about 2.4~2.5 GHz, and the first resonance cavity R1 and the second resonance cavity R2 can resonate at a working band of about 5.15~ about 5.85 GHz. The return loss at the working band of 2.4~2.5 GHz (this range can be larger or smaller) and the return loss at the working band of 5.15~5.85 GHz (this range can be larger or smaller) can be lower than −10 dB (the smaller the dB, the better the quality of signals). When the inductance L is 5 nH, and the capacitance C is 1 pF, the isolation can be significantly increased. For example, the isolation within the working band of 2.4~2.5 GHz and within the working band of 5.15~5.85 GHz both can be reduced to −20 dB (the smaller the dB, the better the isolation).

Figure 8A:
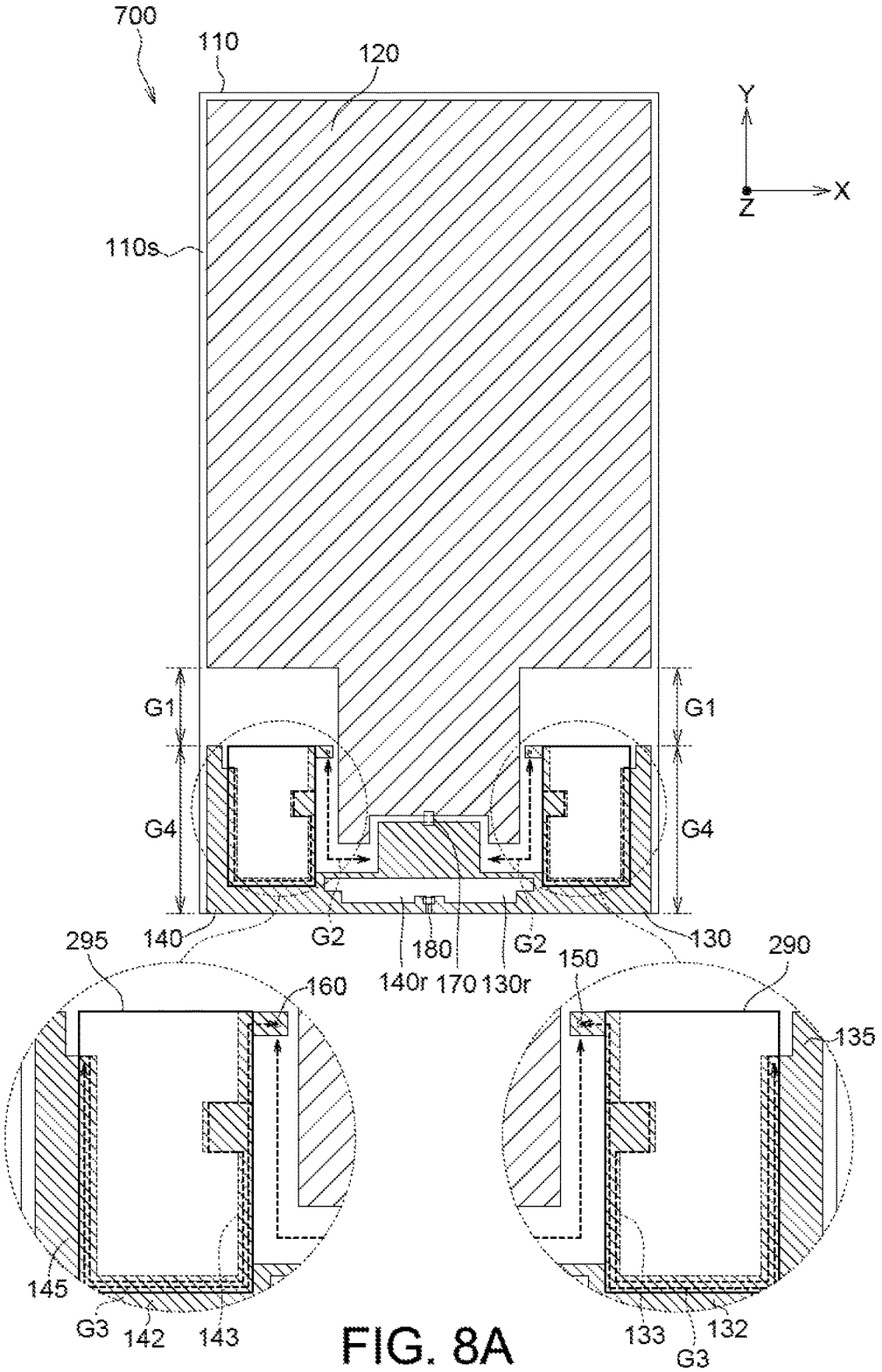
FIG. 8A is according to another embodiment of the invention a top view of an antenna structure.
Figure 8B:
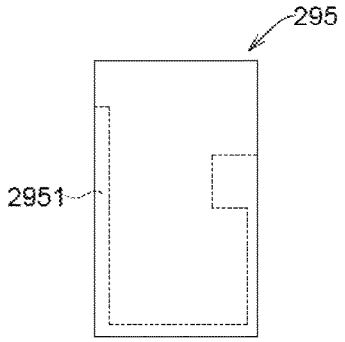
FIG. 8B is a top view of the second electronic element of FIG. 8A.

Refer to FIGS. 8A and 8B. FIG. 8A is according to another embodiment of the invention a top view of an antenna structure 700 FIG. 8B is a top view of the second electronic element 295 of FIG. 8A. The antenna structure 700 includes a substrate 110, a grounding layer 120, a first antenna layer 130, a second antenna layer 140, a first feed point 150, a second feed point 160, an inductance element 170, a capacitance element 180, a first electronic element 290 and a second electronic element 295. The structure of the antenna structure 700 is similar to that of the antenna structure 200, and the similarities are not repeated here.

As indicated in FIG. 8B, the bottom surface of second electronic element 295 has a conductive layer 2951. As indicated in FIG. 8A, when the second electronic element 295 is disposed on the second antenna layer 140, such as disposed on the fourth radiating portion 142, the sixth radiating portion 143 and the tenth radiating portion 145, signals can be transmitted among the second feed point 160, the conductive layer 2951 and the second antenna layer 140. The structure of the first electronic element 290 is similar or identical to that of the second electronic element 295, and the similarities are not repeated here. The connection relationship between the first electronic element 290 is similar to that between the first antenna layer 130 the second electronic element 295 and the second antenna layer 140, and the similarities are not repeated here.

Figure 9:
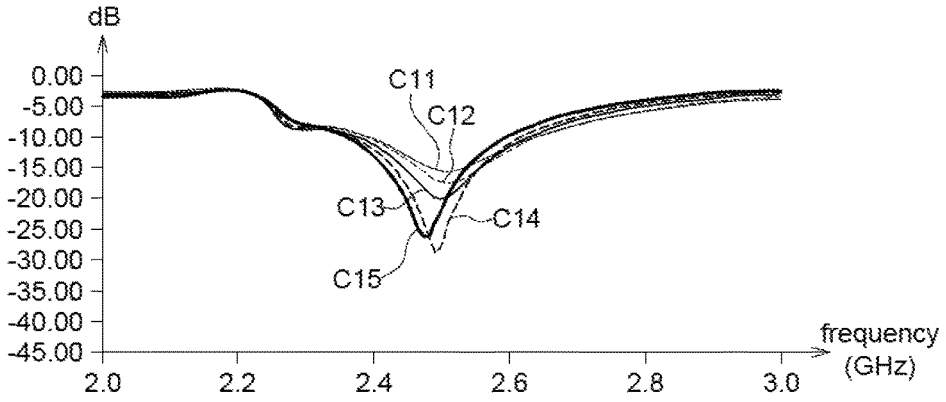
FIG. 9 is a return loss diagram of the antenna structure of FIG. 8A.

FIG. 9 is a return loss diagram of the antenna structure 700 of FIG. 8A. Curves C11~C15 denote the return loss corresponding to different magnitudes of distance G1. As indicated in FIG. 8A, the distance G1 is a distance between the tenth radiating portion 145 of the first antenna layer 130 and the grounding layer 120 and a distance between the ninth radiating portion 135 of the second antenna layer 140 and the grounding layer 120. As indicated in FIG. 9, the magnitude of distance G1 affect the return loss corresponding to the working band of 2.4~2.5 GHz, and curves C11~C15 denote the characteristics corresponding to different magnitudes of distance G1 arranged in order from large to small. In an embodiment, curves C11~C15 denote the return loss corresponding to the distance G1 having a magnitude of 9.5 mm, 8 mm, 6.5 mm, 5 mm and 3.5 mm respectively. When the distance G1 is too large or too small, the minimum return loss cannot be obtained. Of the curves C11~C15, the minimum return loss is achieved when the distance G1 is 5 mm.

Figure 10:
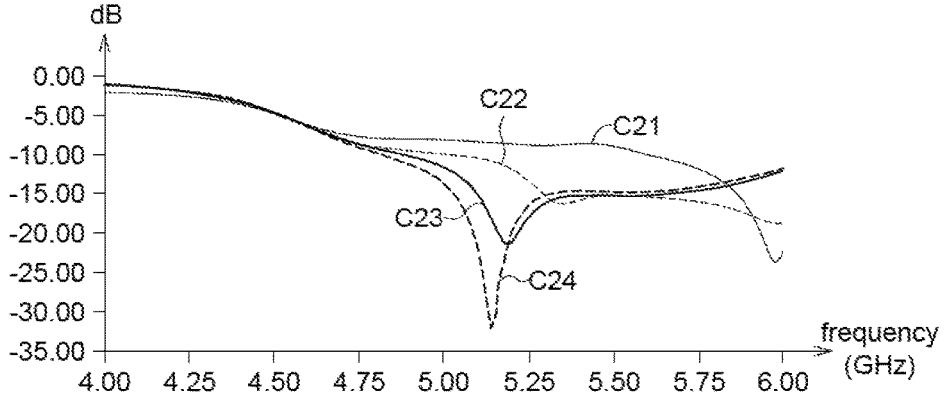
FIG. 10 is a return loss diagram of the antenna structure of FIG. 8A.

FIG. 10 is a return loss diagram of the antenna structure 700 of FIG. 8A. Curve C21~C24 denote the return loss corresponding to different magnitudes of cavity path length G2. As indicated in FIG. 8A, the cavity path length G2 is an extension path length of the first resonance cavity R1 and an extension path length of the second resonance cavity R2. As indicated in FIG. 10, the magnitude of cavity path length G2 affect the return loss corresponding to the working band of 5~5.5 GHz, and curves C21~C24 denote the characteristics corresponding to different magnitudes of cavity path length G2 arranged in order from small to large. In an embodiment, curve C21~C24 denote the return loss corresponding to the cavity path length G2 having a magnitude of 6.75 mm, 9.5 mm, 12 mm and 14.5 mm respectively. Thus, the magnitude of cavity path length G2 affects the range and return loss of the working band. In an embodiment, when the cavity path length G2 is 11.86 mm, the working band whose return loss is smaller than −20 dB and between 5.15~5.85 GHz can be obtained.

Figure 11:
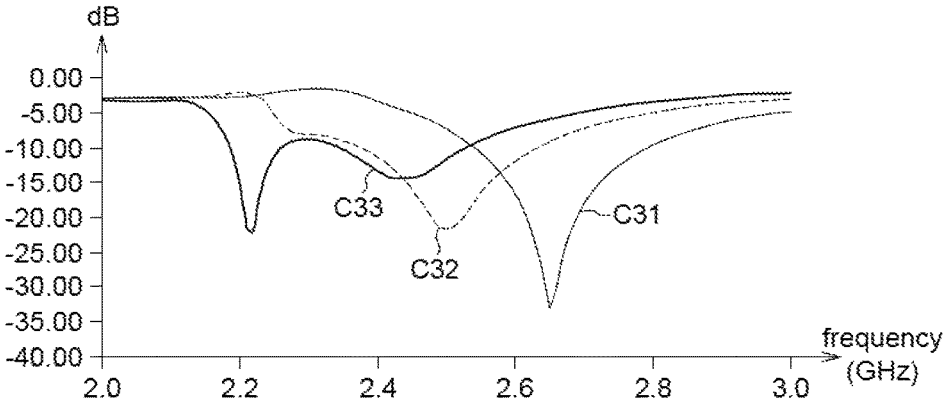
FIG. 11 is a return loss diagram of the antenna structure of FIG. 8A.

FIG. 11 is a return loss diagram of the antenna structure 700 of FIG. 8A. Curves C31~C33 denote the return loss corresponding to different magnitudes of transmission path length G3 of the electronic elements (such as the first electronic element 290 and the second electronic element 295). As indicated in an enlarged view of FIG. 8A, let the second electronic element 295 be taken for example, the transmission path length G3 is a path length through which the current flows the second feed point 160 and the conductive layer 2951 of the second electronic element 295. Let the first electronic element 290 be taken for example, the transmission path length G3 is a path length through which the current flows the first feed point 150 and the conductive layer of the first electronic element 290. As indicated in FIG. 11, the magnitude of transmission path length G3 affects the range and return loss of the working band, and curves C31~C33 denote the characteristics corresponding to different magnitudes of transmission path length G3 arranged in order from small to large. In an embodiment, curve C31~C33 denote the return loss corresponding to the transmission path length G3 having a magnitude of 19.25 mm, 21.75 mm and 24.25 mm respectively. In an embodiment, when the transmission path length G3 is 21.75 mm, a working frequency of 2.4~2.5 GHz can be achieved.

Figure 12A:
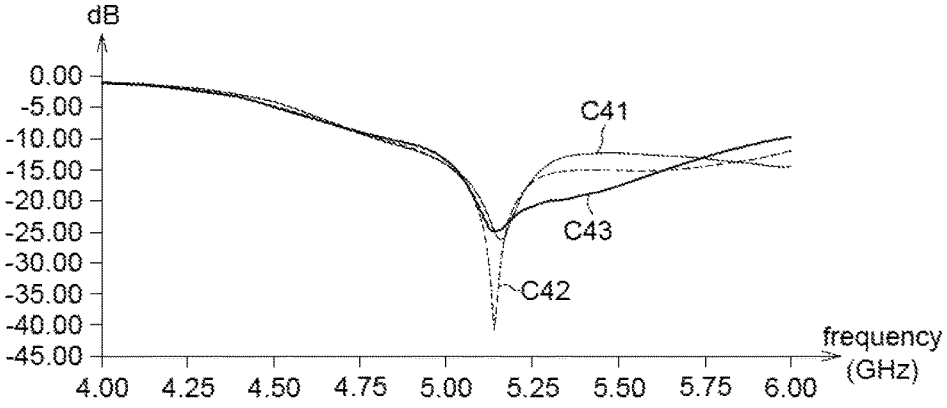
FIG. 12A is a return loss diagram of the antenna structure of FIG. 8A.
Figure 12B:
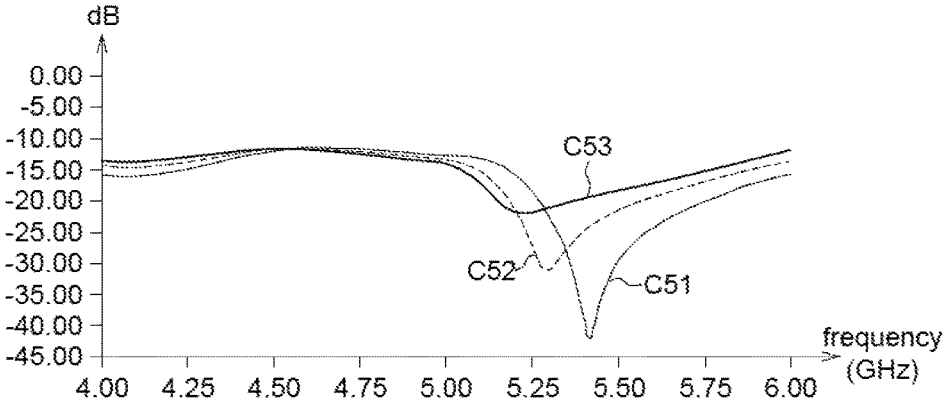
FIG. 12B is an isolation curve diagram of the antenna structure of FIG. 8A.

Refer to FIGS. 12A and 12B. FIG. 12A is a return loss diagram of the antenna structure 700 of FIG. 8A. FIG. 12B is an isolation curve diagram of the antenna structure 700 of FIG. 8A. Curves C41~C43 of FIG. 12A denote the return loss corresponding to different magnitudes of length G4 of the ninth radiating portion 135 and the tenth radiating portion 145. Curves C51~C53 of FIG. 12B denote the isolation corresponding to different magnitudes of length G4 of the ninth radiating portion 135 and the tenth radiating portion 145. As indicated in FIG. 12A, the magnitude of length G4 affects the return loss, and curves C41~C43 denote the characteristics corresponding to different magnitudes of length G4 arranged in order from small to large. In an embodiment, curves C41~C43 denote the return loss corresponding to the length G4 having a magnitude of 9.86 mm, 11.86 mm and 13.86 mm, respectively. As indicated in FIG. 12B, the magnitude of length G4 affects the isolation, and curves C51~C53 denote the characteristics corresponding to different magnitudes of length G4 arranged in order from small to large. In an embodiment, curves C51~C53 denote the isolation corresponding to the length G4 having a magnitude of 9.86 mm, 11.86 mm and 13.86 mm, respectively. In an embodiment, when the length G4 is 11.86 mm, a return loss corresponding to a working frequency of 5.15~5.85 GHz and an isolation complying with the standards (not larger than −20 dB) can be achieved.

Figure 13A:
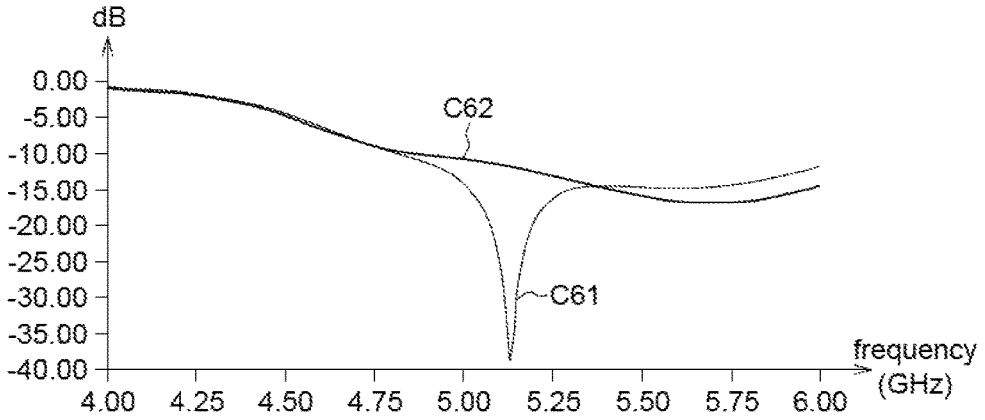
FIG. 13A is a return loss diagram of the antenna structure of FIG. 8A.
Figure 13B:
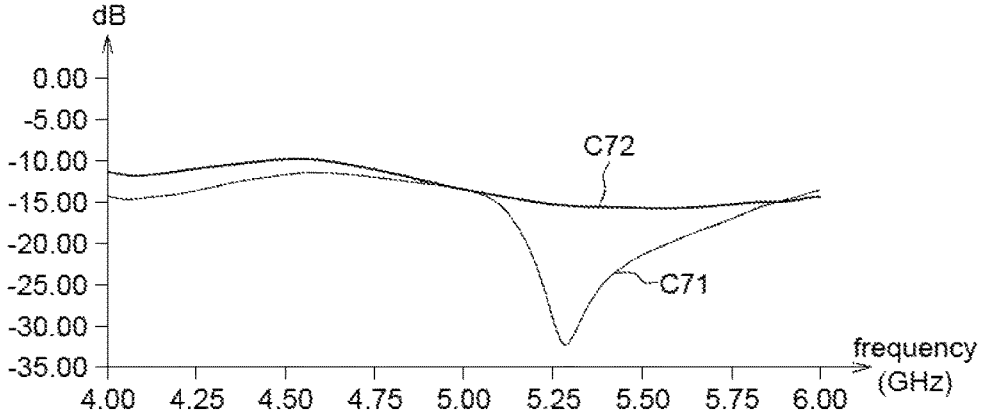
FIG. 13B is an isolation curve diagram of the antenna structure of FIG. 8A.

Refer to FIGS. 13A and 13B. FIG. 13A is a return loss diagram of the antenna structure 700 of FIG. 8A. FIG. 13B is an isolation curve diagram of the antenna structure 700 of FIG. 8A. Curves C61 and C62 of FIG. 13A respectively denote the characteristics corresponding to the design with the recesses (the first recess 130*r* and the second recess 140*r*) and the design dispensing with most or the entirety of the recesses (similar to the structure of FIG. 4). Curves C71 and C72 of FIG. 13B respectively denote the characteristics corresponding to the design with the recess (the first recess 130*r* and the second recess 140*r*) and the design dispensing with most or the entirety of the recesses (similar to the structure of FIG. 4). As indicated in FIGS. 13A and 13B, the design of the first recess 130*r* and the second recess 140*r* significantly reduces the return loss and the isolation.

Figure 14:
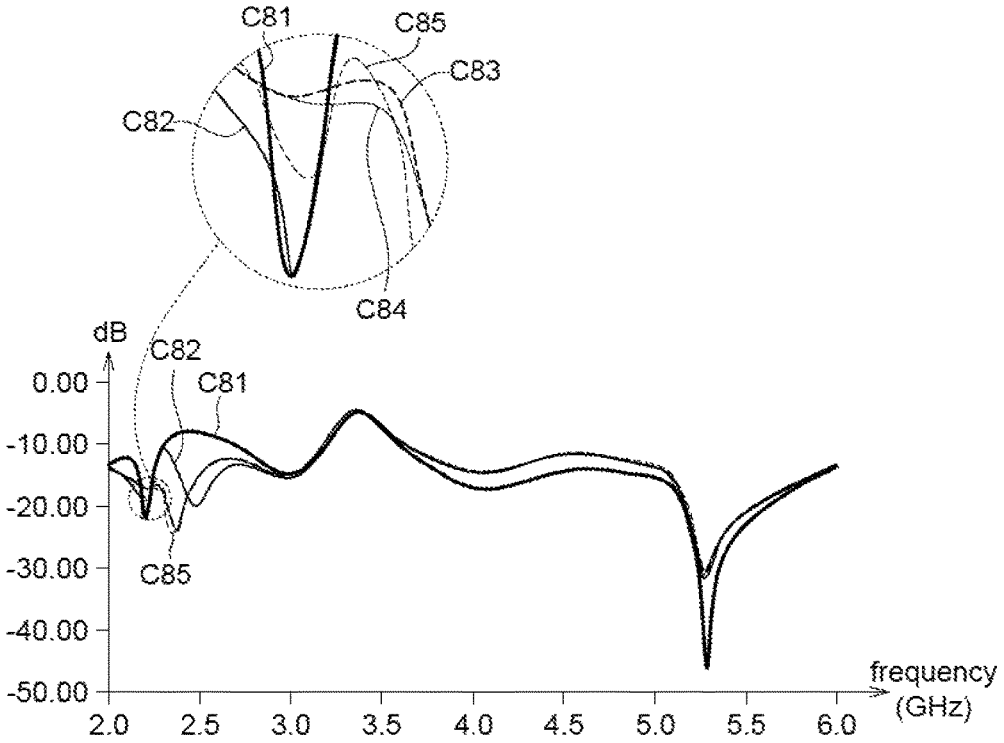
FIG. 14 is an isolation diagram of the antenna structure of FIG. 8A.

FIG. 14 is an isolation diagram of the antenna structure 700 of FIG. 8A. Curves C81~C85 denote the isolation corresponding to different magnitudes of capacitance of the capacitance element 180. As indicated in FIG. 14, the magnitude of capacitance affect the isolation corresponding to the working band of 2~2.5 GHz, and curves C81~C85 denote the characteristics corresponding to different magnitudes of capacitance arranged in order from small to large. In an embodiment, curves C81~C85 denote the isolation corresponding to the capacitance of the capacitance element 180 having a magnitude of 0.01 pF, 0.6 pF, 5 pF, 150 pF and 160 pF respectively. Based on FIG. 14, when the capacitance of the capacitance element 180 is between 0.6~150 pF, a return loss corresponding to a working frequency of 2.4~2.5 GHz and an isolation complying with the standards (not larger than −20 dB) can be achieved.

Figure 15:
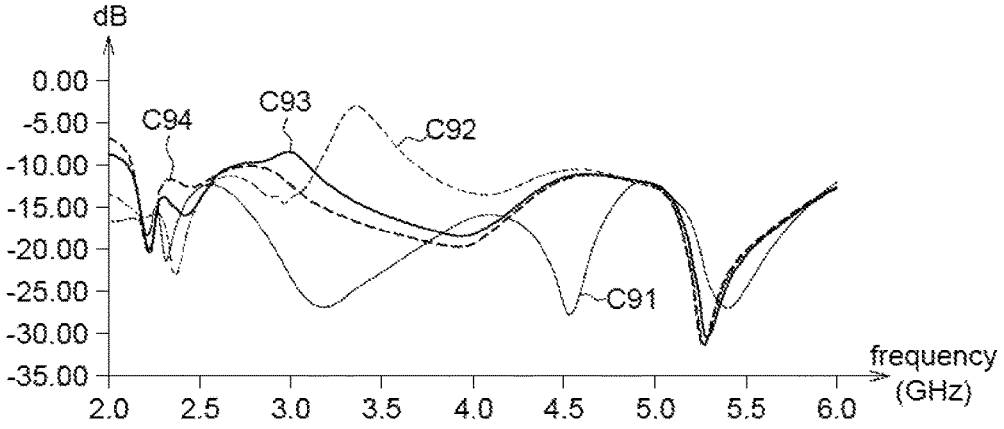
FIG. 15 is an isolation diagram of the antenna structure of FIG. 8A.

FIG. 15 is an isolation diagram of the antenna structure 700 of FIG. 8A. Curves C91~C94 denote the isolation corresponding to different magnitudes of inductance L of the inductance element 170. As indicated in FIG. 15, the magnitude of inductance L affects the isolation corresponding to the working band of 2~2.5 GHz and 5~5.5 GHz, and curves C91~C94 denote the characteristics corresponding to different magnitudes of inductance L arranged in order from small to large. In an embodiment, curves C91~C94 denote the isolation corresponding to the capacitance the L of the inductance element 170 having a magnitude of 1 nH, 7 nH, 22~50 nH respectively. Based on FIG. 15, when the inductance L of the inductance element 170 is large than 6 nH, the isolation corresponding to the working band of 5.15~ about 5.85 GHz can be significantly reduced, and when the inductance L of the inductance element 170 is between 6~22 nH, the isolation corresponding to the working band of 2.4~2.5 GHz can be significantly reduced. Besides, the antenna structure of other embodiment of the invention has technical effects similar to that of FIG. 9~15, and the similarities are not repeated here.

To summarize, the antenna structure of the embodiments of the invention includes a plurality of antenna layers and passive elements. The antenna layers can provide one or more working bands, and makes the antenna structure constitute a multi-input multi-output (MIMO) antenna. The passive elements can resonate at a specific frequency, hence reducing signal interference between the antennas or increasing signal isolation between the antennas. Although when the antennas are disposed within a limited planar space, the transmission quality of signals still can be maintained. The passive elements can be realized by a capacitance element and/or an inductance element. In an embodiment, each antenna layer of the antenna structure has a resonance cavity, which can resonate at a working band different from that provided by the antenna layer. Besides, the resonance cavities of the antenna layers can resonate at a plurality of identical or different working bands.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An antenna structure, comprising:

a substrate having a surface;

a grounding layer formed on the surface of the substrate;

a first antenna layer formed on the surface of the substrate, wherein the first antenna layer comprises a first radiating portion and a second radiating portion connected with the first radiating portion;

a second antenna layer formed on the surface of the substrate, wherein the second antenna layer comprises a third radiating portion and a fourth radiating portion connected with the third radiating portion, the third radiating portion and the first radiating portion are connected at a connection portion, the connection portion and the grounding layer are separated from each other, and the fourth radiating portion and the second radiating portion are disposed oppositely and separated from each other;

an inductance element bridging the grounding layer and the connection portion; and a capacitance element bridging the fourth radiating portion and the second radiating portion.

2. The antenna structure according to claim 1, wherein the first antenna layer further comprises a fifth radiating portion extending towards the grounding layer from the first radiating portion, and a first resonance cavity is surrounded by the grounding layer, the first radiating portion and the fifth radiating portion.

3. The antenna structure according to claim 1, wherein the second antenna layer further comprises a sixth radiating portion extending towards the grounding layer from the third radiating portion, and a second resonance cavity is surrounded by the grounding layer, the third radiating portion and the sixth radiating portion.

4. The antenna structure according to claim 1, wherein the first antenna layer further comprises a fifth radiating portion and a seventh radiating portion, the seventh radiating portion extends towards the grounding layer from the fifth radiating portion, and the antenna structure further comprises a first feed point located on the seventh radiating portion.

5. The antenna structure according to claim 1, wherein the second antenna layer further comprises a sixth radiating portion and a eighth radiating portion, the eighth radiating portion extends towards the grounding layer from the sixth radiating portion, and the antenna structure further comprises a second feed point located on the eighth radiating portion.

6. The antenna structure according to claim 1, wherein the first antenna layer further comprises a fifth radiating portion and a ninth radiating portion, the ninth radiating portion extends to be opposite to the fifth radiating portion from the first radiating portion, and the first radiating portion, the second radiating portion, the fifth radiating portion and the ninth radiating portion constitute a planar inverted-F antenna.

7. The antenna structure according to claim 1, wherein the second antenna layer further comprises a sixth radiating portion and a tenth radiating portion, the tenth radiating portion extends to be opposite to the sixth radiating portion from the third radiating portion, and the third radiating portion, the fourth radiating portion, the sixth radiating portion and the tenth radiating portion constitute a planar inverted-F antenna.

8. The antenna structure according to claim 1, further comprising a first recess and a second recess, wherein the first recess extends from an edge of second radiating portion, the second recess extends from an edge of third radiating portion, and the first recess and the second recess are interconnected.

9. The antenna structure according to claim 1, wherein the grounding layer has a grounding lower edge, the first radiating portion has a first upper edge and a second upper edge which are aligned with each other, and the grounding lower edge is adjacent to and opposite to the first upper edge.

10. The antenna structure according to claim 1, wherein the grounding layer has a grounding lower edge, the first radiating portion has a first upper edge and a second upper edge, the grounding lower edge is adjacent to and opposite to the first upper edge, and a difference of height is formed between the first upper edge and the second upper edge.

11. The antenna structure according to claim 1, wherein the third radiating portion has a third upper edge and a fourth upper edge which are aligned with each other.

12. The antenna structure according to claim 1, wherein the third radiating portion has a third upper edge and a fourth upper edge, and a difference of height is formed between the third upper edge and the fourth upper edge.

13. An antenna structure, comprising:

a substrate having a surface;

a grounding layer formed on the surface of the substrate;

a first antenna layer formed on the surface of the substrate, wherein the first antenna layer comprises a first radiating portion and a second radiating portion connected with the first radiating portion;

a second antenna layer formed on the surface of the substrate, wherein the second antenna layer comprises a third radiating portion and a fourth radiating portion connected with the third radiating portion, the third radiating portion and the first radiating portion are connected at a connection portion, the connection portion and the grounding layer are separated from each other, and the fourth radiating portion and the second radiating portion are disposed oppositely and separated from each other;

a first recess disposed on a slot surrounded by a connection portion of the first radiating portion and the second radiating portion, the first radiating portion and the second radiating portion;

a second recess disposed on another slot surrounded by a connection portion of the third radiating portion and the fourth radiating portion, the third radiating portion and the fourth radiating portion; and a capacitance element bridging the fourth radiating portion and the second radiating portion.

14. The antenna structure according to claim 13, wherein the first antenna layer further comprises a fifth radiating portion extending towards the grounding layer from the first radiating portion, and a first resonance cavity is surrounded by the grounding layer, the first radiating portion and the fifth radiating portion.

15. The antenna structure according to claim 13, wherein the second antenna layer further comprises a sixth radiating portion extending towards the grounding layer from the third radiating portion, and a second resonance cavity is surrounded by the grounding layer, the third radiating portion and the sixth radiating portion.

16. The antenna structure according to claim 13, wherein the first antenna layer further comprises a fifth radiating portion and a seventh radiating portion, the seventh radiating portion extends towards the grounding layer from the fifth radiating portion, and the antenna structure further comprises a first feed point located on the seventh radiating portion.

17. The antenna structure according to claim 13, wherein the second antenna layer further comprises a sixth radiating portion and a eighth radiating portion, the eighth radiating portion extends towards the grounding layer from the sixth radiating portion, and the antenna structure further comprises a second feed point located on the eighth radiating portion.

18. The antenna structure according to claim 13, wherein the first antenna layer further comprises a fifth radiating portion and a ninth radiating portion, the ninth radiating portion extends to be opposite to the fifth radiating portion from the first radiating portion, and the first radiating portion, the second radiating portion, the fifth radiating portion and the ninth radiating portion constitute a planar inverted-F antenna.

19. The antenna structure according to claim 13, wherein the second antenna layer further comprises a sixth radiating portion and a tenth radiating portion, the tenth radiating portion extends to be opposite to the sixth radiating portion from the third radiating portion, and the third radiating portion, the fourth radiating portion, the sixth radiating portion and the tenth radiating portion constitute a planar inverted-F antenna.

20. The antenna structure according to claim 13, further comprising:

an inductance element bridging the grounding layer and the connection portion.

* * * * *